US006695360B1

(12) United States Patent
Forsell et al.

(10) Patent No.: US 6,695,360 B1
(45) Date of Patent: Feb. 24, 2004

(54) LOCKING DEVICE AND BONNET LOCK FOR A VEHICLE COMPRISING SUCH A LOCKING DEVICE

(75) Inventors: Jonas Forsell, Göteborg (SE); Jan Ivarsson, Billdal (SE); Alan Dyche, Tollered (SE); Magnus Lindh, Göteborg (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 09/700,197

(22) PCT Filed: Apr. 15, 1999

(86) PCT No.: PCT/SE99/00599

§ 371 (c)(1),
(2), (4) Date: Feb. 20, 2001

(87) PCT Pub. No.: WO99/61735

PCT Pub. Date: Dec. 2, 1999

(51) Int. Cl.[7] ..... E05C 3/06
(52) U.S. Cl. ..... 292/216; 292/201; 292/DIG. 14
(58) Field of Search ..... 292/201, 225, 292/216, DIG. 23, DIG. 43, DIG. 42, DIG. 14, 341.16

(56) References Cited

U.S. PATENT DOCUMENTS

| | | | | | |
|---|---|---|---|---|---|
| 3,572,793 | A | * | 3/1971 | Cole | 292/216 |
| 3,730,575 | A | * | 5/1973 | Arlauskas et al. | 292/216 |
| 4,635,454 | A | * | 1/1987 | Brown | 70/139 |
| 4,796,929 | A | * | 1/1989 | Gergoe | 292/28 |
| 4,936,611 | A | * | 6/1990 | Palvolgyi | 292/28 |
| 5,048,877 | A | * | 9/1991 | Rogers et al. | 292/110 |
| 5,052,204 | A | * | 10/1991 | Millar | 70/256 |
| 5,150,933 | A | * | 9/1992 | Myslicki et al. | 292/216 |
| 5,738,393 | A | * | 4/1998 | Chao | 292/216 |
| 5,853,060 | A | * | 12/1998 | Chao et al. | 180/69.2 |
| 5,868,444 | A | * | 2/1999 | Brackmann et al. | 292/201 |
| 5,947,536 | A | * | 9/1999 | Mizuki et al. | 292/201 |
| 5,979,951 | A | * | 11/1999 | Shimura | 292/216 |
| 6,050,619 | A | * | 4/2000 | Arabia et al. | 292/216 |
| 6,053,542 | A | * | 4/2000 | Ostrowski et al. | 292/201 |
| 6,123,372 | A | * | 9/2000 | Rogers et al. | 292/216 |
| 6,168,216 | B1 | * | 1/2001 | Nakajima et al. | 292/201 |
| 6,361,091 | B1 | * | 3/2002 | Weschler | 292/336.3 |
| 6,422,616 | B1 | * | 7/2002 | Wortmann et al. | 292/216 |
| 6,519,986 | B2 | * | 2/2003 | Wicker | 70/237 |

FOREIGN PATENT DOCUMENTS

| | | |
|---|---|---|
| DE | 443 13 570 | 10/1994 |
| GB | 907930 | * 10/1962 |
| GB | 1 282 344 | 7/1972 |

* cited by examiner

*Primary Examiner*—Anthony Knight
*Assistant Examiner*—André L. Jackson
(74) *Attorney, Agent, or Firm*—Young & Thompson

(57) ABSTRACT

The invention relates to a lock arrangement comprising a first lock element (2, 2''') which is arranged so as to engage with a second lock element (8), a first retaining element (18, 18', 18'', 18''') which is arranged so as to engage with the first lock element (2, 2'''), and an operating member (24, 26) which is arranged so as to release the first retaining element (18, 18', 18'', 18''') from the first lock element (2), which operating member (24, 26) comprises a cable (24) which is displaceable in a cable sheath (26). The cable sheath (26) is arranged so as to bear against the first retaining element, which cable sheath (26), when the cable (24) is operated, acts with a pressing force on the first retaining member (18, 18', 18'', 18'''). A second retaining element (20, 20', 20''') is arranged so as to interact with the first lock element (2, 2'''), and the cable (24) is arranged in such a manner that it acts on the second retaining element (20, 20', 20''') with a pulling force. The invention also relates to an engine bonnet lock for a vehicle.

20 Claims, 3 Drawing Sheets

LOCKING DEVICE AND BONNET LOCK FOR A VEHICLE COMPRISING SUCH A LOCKING DEVICE

BACKGROUND OF THE INVENTION

The present invention relates to a lock arrangement comprising a first lock element which is arranged so as to engage with a second lock element, a first retaining element which is arranged so as to engage with the first lock element, and an operating member which is arranged so as to release the first retaining element from the first lock element, which operating member comprises a cable which is displaceable in a cable sheath. The invention also relates to an engine bonnet lock for a vehicle.

When the engine bonnet of a vehicle is closed, it must be securely locked in its closed state. This is in order to prevent the engine bonnet being opened by the relative wind and vibrations during operation of the vehicle, which could lead to a road accident. In the event of a head-on collision, the engine bonnet must be deformed in a predetermined manner so that the driver and the passengers in the vehicle are not injured. It is therefore important that the lock arrangement is capable of retaining the engine bonnet in the closed state during the collision. It is also important for the engine bonnet to be locked in the closed state when the vehicle is parked because theft of components in the engine space is then prevented.

Known lock arrangements for engine bonnets are often operated by a cable from the passenger compartment of the vehicle. Arranged around the cable is a cable sheath in which the cable can run. By pulling a lever which is located in the passenger compartment of the vehicle and connected to the cable, the engine bonnet can be unlocked. The cable then acts on the lock arrangement with a pulling force so that the engine bonnet is unlocked.

It has been found, however, that the chassis of the vehicle or components in the engine space can affect the cable during a collision in which major deformations take place, the bonnet lock sometimes being opened at the end of the collision sequence, so that the engine bonnet is unlocked, which can lead to the driver and the passengers in the vehicle being injured, as mentioned above. Previously this problem has been solved by using two interacting bonnet locks, which, according to the invention, can be replaced by one lock.

Another possible disadvantage is that parts of the cable are accessible from the underside of the vehicle by means of, for example, a specially made breaking-in tool, because the engine space is open to the bottom. This means that the engine bonnet can be opened by inserting a breaking-in tool into the engine space from underneath and pulling the cable, after which components in the engine space can be stolen.

SUMMARY OF THE INVENTION

The object of the present invention is to produce a lock arrangement which remains locked when only a pulling force from an operating member acts on the lock arrangement.

This is achieved with a lock arrangement of the type indicated in the introduction, the cable sheath of which is arranged so as to bear against the first retaining element, which cable sheath, when the cable is operated, acts with a pressing force on the first retaining member, a second retaining element being arranged so as to interact with the first lock element and the cable being arranged in such a manner that it acts on the second retaining element with a pulling force.

Another object of the present invention is to produce an engine bonnet lock which remains locked during a collision.

A further object of the present invention is to produce an engine bonnet lock which impedes improper opening of an engine bonnet of a vehicle.

This is achieved with an engine bonnet lock which comprises a lock arrangement according to Claim 1.

With such a lock arrangement and engine bonnet lock, it is not possible to unlock the lock arrangement and the engine bonnet lock by taking hold of and pulling the cable and the cable sheath because a pressing force has to act on the retaining element on unlocking. This results in the engine bonnet remaining locked in the event of a collision if a component in the engine space should catch on the cable and the cable sheath and in this way bring about a pulling force on the latter.

BRIEF DESCRIPTION OF THE DRAWINGS

The invention will be described in greater detail below with reference to the appended drawings showing exemplary embodiments, in which.

DESCRIPTION OF THE PREFERRED EMBODIMENTS

Figure 1:
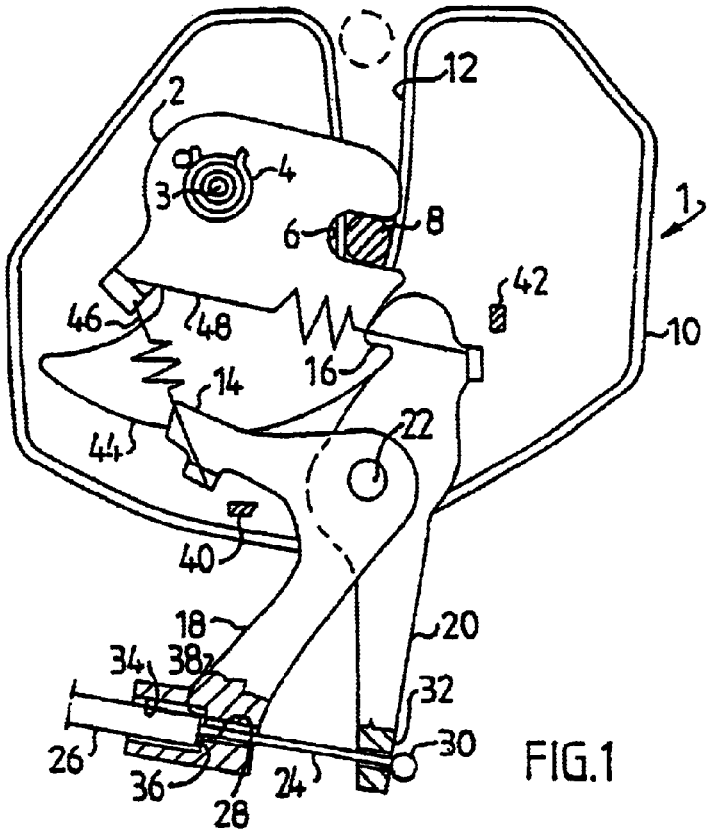
FIG. 1 shows a first, preferred embodiment of the invention.

FIG. 1 shows a first, preferred embodiment of a lock arrangement 1 according to the present invention. The lock arrangement 1 comprises a first lock element 2 which is plate-shaped and mounted around a first spindle 3. Arranged around the first spindle 3 is a coil spring 4 of the torsion type, which is preloaded and tends to rotate the first lock element 2 anti-clockwise in FIG. 1.

The coil spring 4 thus tends to rotate the first lock element 2 so that the lock arrangement 1 is unlocked. The first lock element 2 is provided with a first recess 6 which is intended to engage with a second lock element 8 which, according to the embodiment shown, has a circular cross section. The second lock element 8 can consist of, for example, a ring arranged on an engine bonnet of a vehicle (not shown).

The first lock element 2 is preferably arranged in a housing 10 which has a slot 12 into which the second lock element 8 can be inserted for interaction with the first lock element 2. The housing 10 can be arranged on, for example, a body of a vehicle so as to interact with the ring arranged on the engine bonnet.

The first lock element 2 is also provided with a second and a third recess 14 and, respectively, 16 for engaging with a first and a second retaining element 18 and, respectively, 20. The first and second retaining elements 18 and 20 engage with the second and the third recess 14 and 16 when the lock arrangement 1 is in the locked state, that is to say when the first lock element 2 engages with the second lock element 8 and prevents the second lock element 8 from leaving the slot 12 in the housing 10.

The first and second retaining elements 18 and 20 are preferably plate-shaped and mounted around a common second spindle 22. An elongate operating member, in the form of a cable 24 and a cable sheath 26, is arranged so as to act on the first and second retaining elements 18 and 20. The cable 24 extends and runs freely through a hole 28 arranged in the first retaining element 18 and continues to the second retaining element 20. The cable 24 is provided, at its outer end, with a stop 30 which bears against a projection 32 of the second retaining element 20. The cable sheath 26, which is arranged around the cable 24, extends into a bore 34 in the first retaining element 18 and bears with an end surface 36 against the bottom 38 of the bore 34.

By applying a pulling force to the cable 24, a reaction force arises in the cable sheath 26, which acts in the opposite direction to the pulling force on the cable 24. The cable 24 will thus act with a pulling force on the second retaining element 20, and the cable sheath 26 will act with a pressing force on the first retaining element 18. This results in the first retaining element 18 being rotated anti-clockwise around the second spindle 22 in FIG. 1 and the second retaining element 20 being rotated clockwise around the second spindle 22 in FIG. 1. In this connection, the first and the second retaining element 18 and 20 will leave the second and the third recess 14 and 16 in the first lock element 2, which results in the first lock element 2 being released from the first and the second retaining element 18 and 20. The first lock element 2 will then, under the action of the coil spring 4, be rotated anti-clockwise in FIG. 1 and release the second lock element 8. A first and a second stop member 40 and, respectively, 42 are arranged so as to limit the movement of the first and the second retaining element 18 and 20 when the cable 24 and the cable sheath 26 are acted on. This means that the retaining element 18 or 20 which is acted on first by the cable 24 or the cable sheath 26 respectively will leave the recess 14 or, respectively, 16 in the first lock element 2 and be stopped by the stop member 40 or, respectively, 42. Subsequently, the retaining element 18 or 20 which has not yet left the recess 14 or, respectively, 16 in the first lock element 2 is acted on. When the pulling force on the cable 24 and thus the pressing force on the cable sheath 26 ceases, the first and second retaining elements 18 and 20 will bear against a cam surface 44 of the first lock element 2. A first and a second tension spring 46 and, respectively, 48, which are fixed between the first lock element 2 and the first and, respectively, the second retaining element 18 and 20, ensure that the second and the first retaining element 20 and 18 bear against the cam surface 44 of the first lock element 2. It is possible for the springs 46 and 48 to replace the coil spring 4.

When the second lock element 8 is inserted by force into the slot 12 and engages with the first recess 6 in the first lock element 2, the first lock element 2 will, under the action of the force from the second lock element 8, be rotated clockwise in FIG. 1 until the second lock element 8 reaches the bottom of the slot 12. In this state, the first and the second retaining element 18 and 20 engage with the second and the third recess 14 and 16 in the first lock element 2.

By allowing the cable 24 and thus the cable sheath 26 to wind with one or more curves 26' with a radius between their outer ends, a considerable reaction force is obtained from the cable sheath 26 when a pulling force is applied to the cable 24. This reaction force is obtained by virtue of the fact that the radius of curvature of the curved cable 24 and cable sheath 26 decreases when a pulling force is applied to the cable 24. The cable sheath 26 then undergoes a change in length which gives rise to a pressing force on the first retaining element 18.

For acting on the lock arrangement, a lever (not shown) is suitably arranged in the passenger compartment of the vehicle, with which lever the cable 24 is tensioned and the engine bonnet is unlocked. It is possible for the lever arranged in the vehicle passenger compartment to be arranged so as to press the cable sheath 26 in the direction of the first retaining element 18 in order thus to unlock the engine bonnet.

In FIG. 1, the first and second lock elements 2 and 8 and the retaining elements 18 and 20 are shown in solid lines in the locked state of the lock arrangement 1 and in dashed lines in the unlocked state of the lock arrangement 1.

Figure 2:
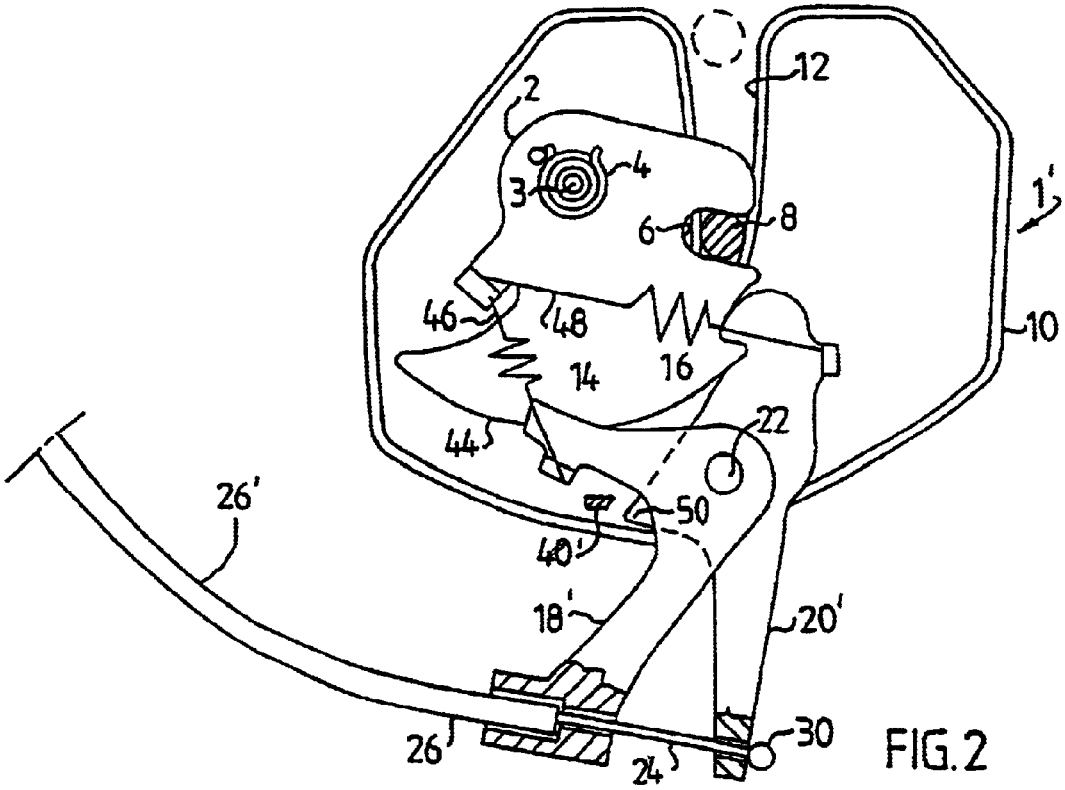
FIG. 2 shows a second embodiment of the invention.

FIG. 2 shows a second embodiment of the invention. This embodiment differs from the first embodiment in that the lock arrangement 1' has only one stop member 40' which is intended to interact with both the first and the second retaining element 18' and 20'. The second retaining element 20' is thus provided with a protruding part 50 which will bear against the stop member 40' when the cable 24 rotates the second retaining element 20' around the second spindle 22.

Figure 3:
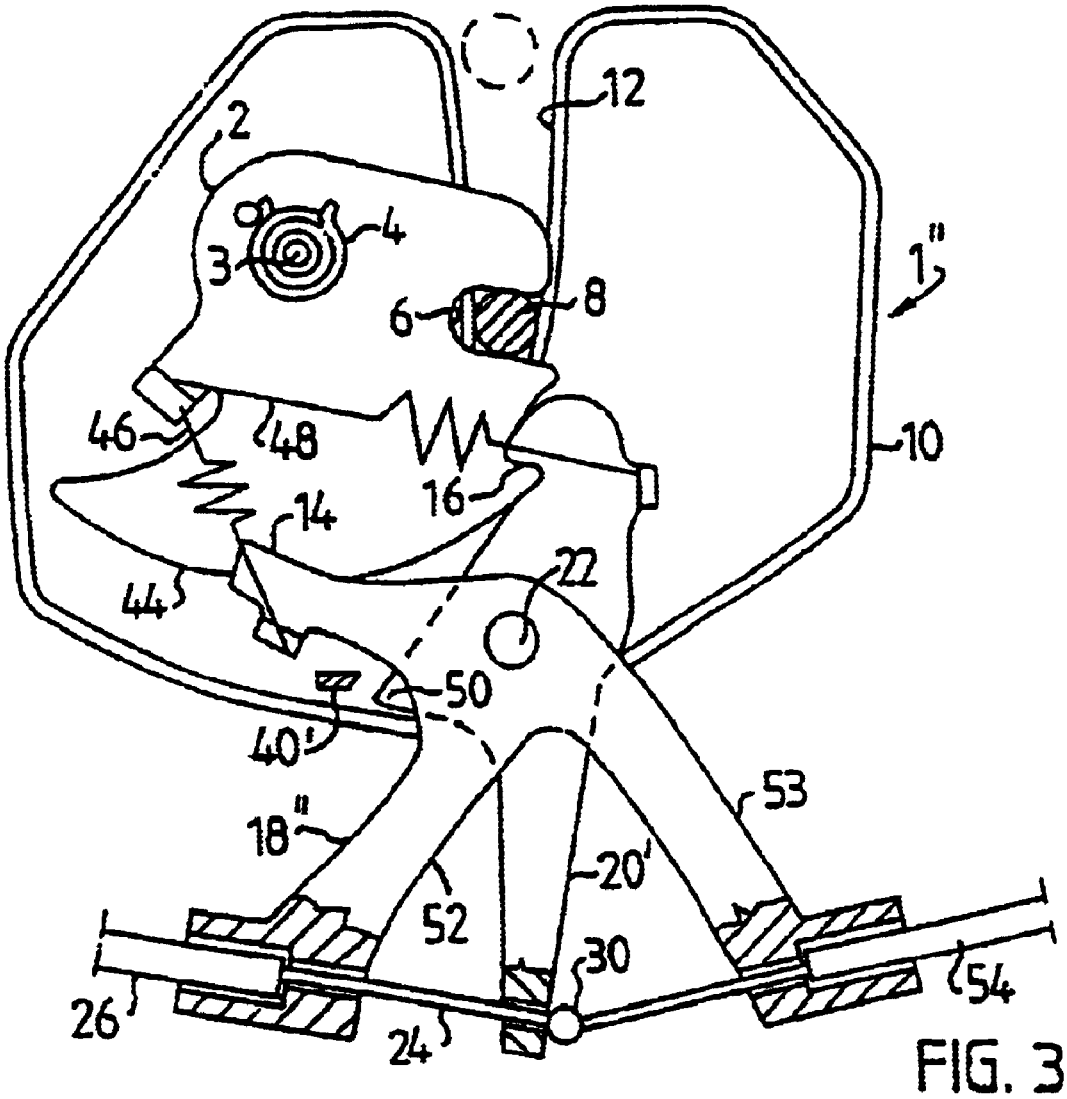
FIG. 3 shows a third embodiment of the invention.

According to a third embodiment of a lock arrangement 1", which is shown in FIG. 3, the first retaining element 18" comprises a first and a second leg 52 and, respectively, 53. According to this embodiment, the cable 24 extends through the first leg 52, then through the second retaining element 20' and on through the second leg 53. From the second leg 53, the cable 24 continues to another lock arrangement (not shown) which, for example, can be designed like the lock arrangement according to FIG. 1 or FIG. 2. A stop 30 is arranged on the cable 24 and bears against the second retaining element 20'. When a pulling force is applied to the cable 24, a reaction force arises in the cable sheath 26, which acts in the opposite direction to the pulling force on the cable 24. The cable 24 will thus act with a pulling force on the second retaining element 20', and the cable sheath 26 will act with a pressing force on the first leg of the first retaining element 18". This results in the first retaining element 18" being rotated anti-clockwise around the second spindle 22 in FIG. 3 and the second retaining element 20' being rotated clockwise around the second spindle 22 in FIG. 3. When the first retaining element 18" is rotated anti-clockwise around the second spindle 22, the second leg 53 of the first retaining element 18" will act with a pressing force against a second cable sheath 54 which is arranged around the cable 24 and extends between the second leg 53 of the first retaining element and the other lock arrangement (not shown). The force from the cable 24 and the second cable sheath 54 will thus also unlock the other lock arrangement.

Figure 4:
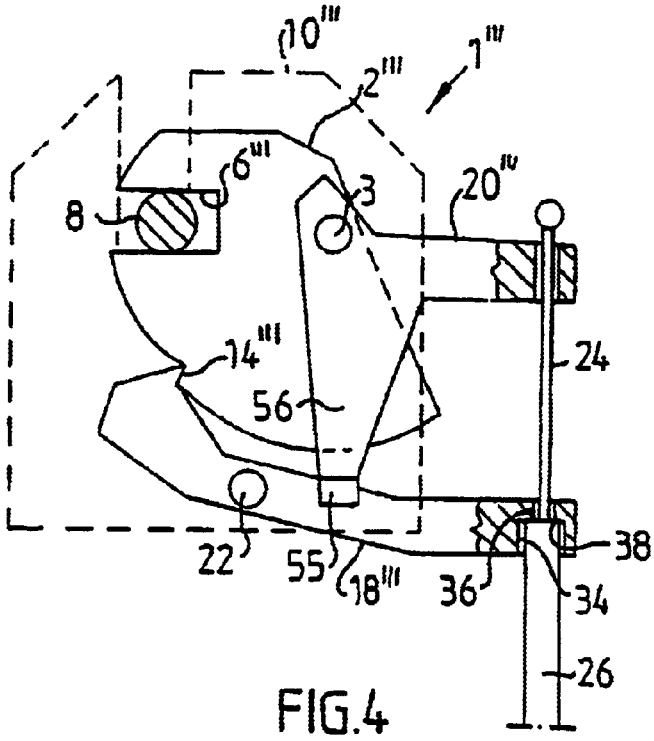
FIG. 4 shows a fourth embodiment of the invention.

FIG. 4 shows a fourth embodiment of a lock arrangement 1'" which comprises a housing 10'" in which a first lock element 2'" is mounted around a first spindle 3. The first lock element 2'" is provided with a first recess 6'" which is intended to engage with a second lock element 8. Also mounted around the first spindle 3 is a second retaining element 20'" which is connected to and can be acted on by a cable 24.

In the housing 10'", a first retaining element 18'" is also mounted around a second spindle 22, which first retaining element 18'" is designed so as to engage in a second recess 14'" which is formed in the first lock element 2'". When the first retaining element 18'" engages in the second recess 14'" of the first lock element 2'", the first lock element 2'" is prevented from being rotated around the first spindle 3.

The first retaining element 18'" is provided with a projection 55 which, when the lock arrangement is in a locked state, bears against a protruding part 56 of the second retaining element 20'". The first retaining element 18'" is thus prevented from being rotated around the second spindle 22.

The cable 24 extends and runs freely through the first retaining element 18'''. A cable sheath 26 arranged around the cable 24 bears with an end surface 36 against a bottom 38 of a bore 34 arranged in the first retaining element 18'''.

Figure 5:
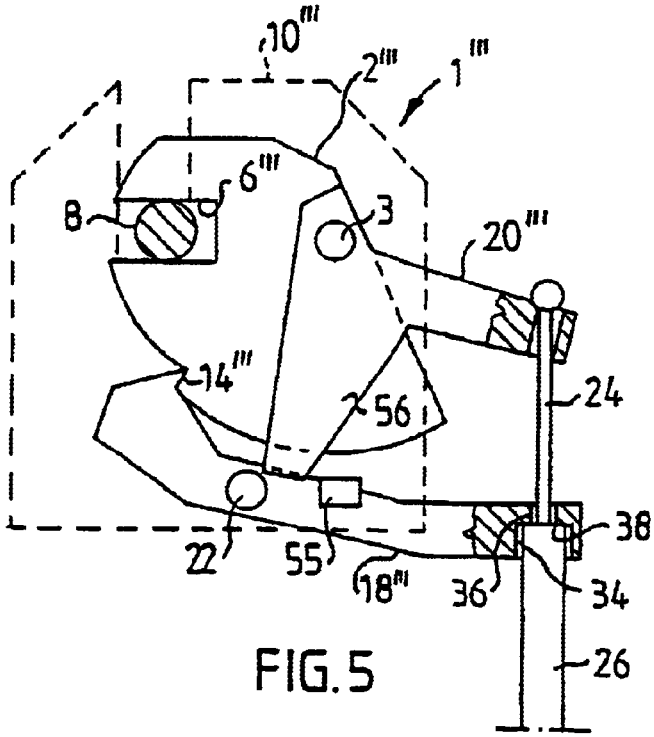
FIG. 5 shows the fourth embodiment of the invention when a retaining element has been acted on by a cable.

The lock arrangement 1''' according to the fourth embodiment is unlocked by applying a pulling force to the cable 24, which results in the second retaining element 20''' being rotated clockwise, as shown in FIG. 5. The protruding part 56 thus leaves the projection 55 arranged on the first retaining element 18'''. At the same time as a pulling force is applied to the cable 24, a pressing force is also applied to the cable sheath 26, as has been described in connection with the embodiments above. The pressing force on the cable sheath 26 causes the first retaining element 18''' to be rotated around the second spindle 22, so that the first retaining element 18''' is released from the second recess 14''' in the first lock element 2'''. The first lock element 2''' is thus released, so that it can be rotated around the first spindle 3, which results in the second lock element 8 being able to leave the first recess 6''' formed in the first lock element 2'''.

The lock arrangement according to the embodiments above has been described in connection with an engine bonnet lock. However, the lock arrangement can advantageously also be used as a door lock or as a lock arrangement for a tank cap or a rear hatch.

What is claimed is:

1. A lock arrangement comprising:

a first lock element and a second lock element, said first lock element engaging said second lock element;

a first retaining element engaging said first lock element;

an operating member that disengages said first retaining element from said first lock element, said operating member comprising a cable displaceable within a sheath, wherein said sheath bears against said first retaining element and presses against said first retaining element when said cable is operated; and a second retaining element that interacts with said first lock element and that is pulled by said cable when said cable is operated, wherein the press of said sheath moves said first retaining element and the pull of said cable moves said second retaining element relative to said first retaining element to release said second lock element from said first lock element when said cable is operated.

2. The lock arrangement of claim 1, wherein said operating member comprises a curved portion whose radius varies when said cable is operated.

3. The lock arrangement of claim 1, further comprising a first spindle about which said first lock element is rotatably arranged.

4. The lock arrangement of claim 1, further comprising a second spindle about which said first retaining element is rotatably arranged.

5. The lock arrangement of claim 1, wherein said first lock element comprises a first recess for engaging said second lock element.

6. The lock arrangement of claim 1, wherein said first lock element comprises a cam surface that guide movement of said first and second retaining elements.

7. The lock arrangement of claim 1, wherein said first retaining element comprises first and second legs through which said cable extends, said sheath pressing against said first leg, and further comprising a second sheath that presses against said second leg.

8. The lock arrangement of claim 1, wherein said second retaining element engages said first lock element.

9. The lock arrangement of claim 1, further comprising a first stop element that limits movement of said first retaining element.

10. The lock arrangement of claim 9, wherein said first stop also limits movement of said second retaining element.

11. A lock arrangement comprising:

a first lock element and a second lock element, said first lock element engaging said second lock element;

a first retaining element engaging said first lock element;

an operating member that disengages said first retaining element from said first lock element, said operating member comprising a cable displaceable within a sheath, wherein said sheath bears against said first retaining element and presses against said first retaining element when said cable is operated; and a second retaining element that engages said first lock element and that is pulled by said cable when said cable is operated, wherein the press of said sheath moves said first retaining element and the pull of said cable moves said second retaining element relative to said first retaining element to disengage said second retaining element from said first lock element when said cable is operated, whereby said second lock element is released from said first lock element.

12. The lock arrangement of claim 11, wherein said operating member comprises a curved portion whose radius varies when said cable is operated.

13. The lock arrangement of claim 11, further comprising a first spindle about which said first lock element is rotatably arranged.

14. The lock arrangement of claim 11, further comprising a second spindle about which said first retaining element is rotatably arranged.

15. The lock arrangement of claim 11, wherein said first lock element comprises a first recess for engaging said second lock element.

16. The lock arrangement of claim 11, wherein said first retaining element comprises first and second legs through which said cable extends, said sheath pressing against said first leg, and further comprising a second sheath that presses against said second leg.

17. The lock arrangement of claim 11, further comprising a first stop element that limits movement of said first retaining element.

18. The lock arrangement of claim 17, wherein said first stop also limits movement of said second retaining element.

19. A lock arrangement comprising:

a first lock element and a second lock element, said first lock element engaging said second lock element;

a first retaining element engaging said first lock element;

an operating member that disengages said first retaining element from said first lock element, said operating member comprising a cable displaceable within a sheath, wherein said sheath bears against said first retaining element and presses against said first retaining element when said cable is operated; and a second retaining element that interacts with said first retaining element and that is pulled by said cable when said cable is operated, wherein the press of the said sheath moves said first retaining element and the pull of said cable moves said second retaining element to disengage from said first retaining element and to release said second lock element from said first lock element when said cable is operated.

20. The lock arrangement of claim 19, wherein said first retaining element comprises a projection and said second retaining element comprise a protruding part, said projection and said protruding part bearing against each other when said first lock element engages said second lock element and being spaced from each other when said first lock element releases said second lock element.

* * * * *

UNITED STATES PATENT AND TRADEMARK OFFICE

CERTIFICATE OF CORRECTION

PATENT NO. : 6,695,360 B1
DATED : February 24, 2004
INVENTOR(S) : Jonas Forsell et al.

It is certified that error appears in the above-identified patent and that said Letters Patent is hereby corrected as shown below:

Title page,
Below Item [87], insert item:
-- [30] Foreign Application Priority Data
May 12, 1998 (SE) …….9801645 --.

Signed and Sealed this

Eighteenth Day of May, 2004

JON W. DUDAS
*Acting Director of the United States Patent and Trademark Office*